US007896072B2

(12) United States Patent
Daussin et al.

(10) Patent No.: US 7,896,072 B2
(45) Date of Patent: Mar. 1, 2011

(54) CALORIMETRIC DISTRIBUTED TEMPERATURE SYSTEM AND METHODS

(75) Inventors: Rory D. Daussin, Spring, TX (US); Ron G. Dusterhoft, Katy, TX (US); Mary S. Van Domelen, el Maadi (EG); Gerard Glasbergen, Gaida (NL)

(73) Assignee: Halliburton Energy Services, Inc., Duncan, OK (US)

( * ) Notice: Subject to any disclaimer, the term of this patent is extended or adjusted under 35 U.S.C. 154(b) by 109 days.

(21) Appl. No.: 12/290,999

(22) Filed: Nov. 5, 2008

(65) Prior Publication Data

US 2010/0108311 A1 May 6, 2010

(51) Int. Cl.
*E21B 47/06* (2006.01)

(52) U.S. Cl. ..... 166/250.01; 702/6; 73/152.12

(58) Field of Classification Search ..... 166/250.01, 166/250.09, 300, 308.5; 702/11, 6; 73/152.12, 73/152.54

See application file for complete search history.

(56) References Cited

U.S. PATENT DOCUMENTS

| | | | | |
|---|---|---|---|---|
| 3,480,079 | A * | 11/1969 | Sherwood et al. | 166/250.01 |
| 3,727,691 | A | 4/1973 | Muecke et al. | 166/295 |
| 7,055,604 | B2 | 6/2006 | Jee et al. | 166/305.1 |
| 7,240,547 | B2 | 7/2007 | Brown | 73/204.11 |
| 2006/0010973 | A1 | 1/2006 | Brown | 73/204.11 |
| 2006/0196659 | A1 | 9/2006 | Jee et al. | 166/250.01 |
| 2007/0137860 | A1 | 6/2007 | Lovell et al. | 166/250.01 |
| 2007/0234788 | A1 | 10/2007 | Glasbergen et al. | 73/152.12 |

OTHER PUBLICATIONS

U.S. Appl. No. 11/398,483, filed Apr. 5, 2006, Glasbergen.
SPE 100617 "Real-Time Monitoring of Acid Stimulation Using a Fiber-Optic DTS System," R.W. Clanton, et al., 2006.
Gerald Glasbergen, et al., "Real Time Fluid Distribution Determination in Matrix Treatments Using DTS," SPE 10775, 2007.
Richard D. Rickman, et al., "Kinetic Parameters for Dilute Epoxy Resins Measured by Nuclear Magnetic Resonance Spectroscopy," SPE 106160, 2007.
T. M Aity, et al., "C Uring Study of Expoxy by New Aromatic Amine Fuctional Curing Agents Along With Mechanical and Thermal Evaluation," Materials Science & Engineering, pp. 38-46, 2007.
Christopher W. Wise, et al., "Chemico-Diffusion Kinetics of Model Epoxy-Amine Resins," Polymer, 38, pp. 3251-3261, 1997.
Moon-Kwang Um, et al., "A Study of Cure Kinetics by the Use of Dynamic Differential Scanning Calorimetry," Composites Science and Technology, 62, pp. 29-40, 2002.
D. Rosu, et al., "Investigation of the Curing Reactions of Some Multifunctional Epoxy Resins Using Differential Scanning Calorimetry," Thermochimica Acta, 370, pp. 105-110, 2001.
A.Padma, et al., "Cure Characterization of Triglycidyl Epoxy/Aromatic Amine Systems," Journal of Applied Polymer Science, 57, pp. 41, 1995.

* cited by examiner

*Primary Examiner* — Kenneth Thompson
(74) *Attorney, Agent, or Firm* — Robert A. Kent; Booth Albanesi Schroeder LLC

(57) ABSTRACT

Methods for designing and performing a treatment operation on a subterranean formation penetrated by a wellbore are provided, in which the treatment operation includes the use of a treatment fluid comprising reactants for a chemical reaction. The methods generally include the step of obtaining wellbore temperature-profile information on the wellbore and obtaining kinetic or thermodynamic data for the chemical reaction, and combining the information to help design the treatment operation. Preferably, the methods include the use of a distributed temperature system ("DTS") for gaining temperature-profile information for a wellbore.

21 Claims, 2 Drawing Sheets

CALORIMETRIC DISTRIBUTED TEMPERATURE SYSTEM AND METHODS

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

SUMMARY OF THE INVENTION

Oilfield services operations often include chemical treatment processes to enhance the recovery of oil and gas. In some cases, reactive chemicals are mixed or blended on the surface and allowed to react as the material is pumped downhole and into the formation. The invention is generally directed to methods for designing and performing a treatment operation on a subterranean formation penetrated by a wellbore, wherein the treatment operation includes the use of a treatment fluid comprising reactants for a chemical reaction. The methods generally include the step of obtaining temperature-profile information on the wellbore and obtaining kinetic or thermodynamic data for the chemical reaction, and combining the information to design the treatment operation. Preferably, the methods include the use of a distributed temperature system ("DTS") for gaining the temperature-profile information for the wellbore.

According to one aspect of the invention, a method is provided including the steps of: (a) obtaining wellbore temperature-profile information; (b) obtaining kinetic information of the extent of the chemical reaction over time under at least one test temperature profile for a test fluid comprising the reactants for the chemical reaction; (c) analyzing at least the wellbore temperature-profile information and the kinetic information: (i) to help design the composition of the treatment fluid, or (ii) to help design a treatment set of introducing conditions for introducing the treatment fluid through the wellbore into the subterranean formation; and (d) introducing the treatment fluid through the wellbore into the subterranean formation according to the treatment set of introducing conditions. This method may further comprise the steps of: (a) measuring the treatment temperature-profile for the treatment fluid when it is introduced through the wellbore into the subterranean formation under the treatment set of introducing conditions; (b) obtaining heat-of-reaction information for the chemical reaction; (c) analyzing at least the wellbore temperature-profile information, the treatment temperature-profile information, and the heat of reaction to help estimate the extent of the chemical reaction as the fluid enters the subterranean formation and to help design a minimum residence time for the treatment fluid in the subterranean formation at the temperature of the subterranean formation to allow for at least a desired percent completion of the chemical reaction; and (d) shutting-in the well to provide at least the designed minimum residence time.

According to another aspect of the invention, a method is provided including the steps of: (a) obtaining wellbore temperature-profile information; (b) obtaining kinetic information of the extent of the chemical reaction over time under at least one test temperature profile for a test fluid comprising the reactants for the chemical reaction; (c) analyzing at least the wellbore temperature-profile information and the kinetic information to help design a minimum residence time for the treatment fluid in the subterranean formation at the static temperature of the subterranean formation to allow for at least a desired percent completion of the chemical reaction; (d) introducing the treatment fluid through the wellbore into the subterranean formation under a treatment set of introducing conditions; and (e) shutting-in well to provide at least the designed minimum residence time. This method may further comprise the steps of: (a) measuring the treatment temperature-profile for the treatment fluid when it is introduced through the wellbore into the subterranean formation under the treatment set of introducing conditions; and (b) obtaining heat-of-reaction information for the chemical reaction; wherein the step of analyzing further comprises analyzing with the treatment temperature-profile information and the heat-of-reaction information.

According to yet another aspect of the invention, a method is provided including the steps of: (a) obtaining wellbore temperature-profile information; (b) measuring the treatment temperature-profile for the treatment fluid when it is introduced through the wellbore into the subterranean formation under the treatment set of introducing conditions; (c) obtaining heat-of-reaction information for the chemical reaction; (d) analyzing at least the wellbore temperature-profile information, the treatment temperature-profile information, and the heat of reaction to help estimate the extent of the chemical reaction as the fluid enters the subterranean formation and to help design a minimum residence time for the treatment fluid in the subterranean formation at the temperature of the subterranean formation to allow for at least a desired percent completion of the chemical reaction; and (e) shutting-in well to provide at least the designed minimum residence time. This method may further comprise the step: obtaining kinetic information of the extent of the chemical reaction over time under at least one test temperature profile for a test fluid comprising the reactants for the chemical reaction; wherein the step of analyzing further comprises analyzing with the kinetic information.

These and further aspects and embodiments of the inventions and various advantages of the aspects and embodiments of the inventions are in the detailed description.

BRIEF DESCRIPTION OF THE DRAWING

A more complete understanding of the present inventions and the advantages thereof may be acquired by referring to the following description taken in conjunction with the accompanying drawings in which.

DETAILED DESCRIPTION OF PREFERRED EMBODIMENTS

Figure 1:
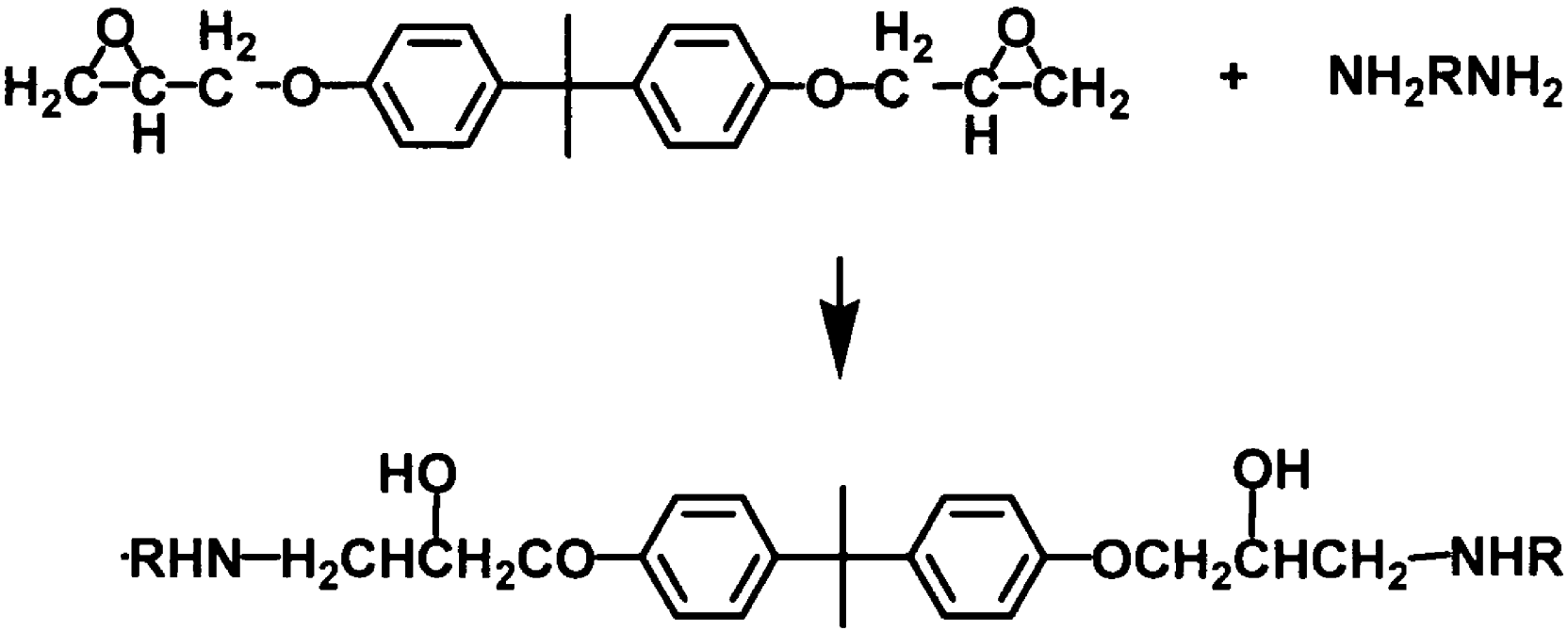
FIG. 1 shows a typical reaction of a diepoxide with a diamine to form an epoxy resin.

In one respect, the invention is generally related to a system and method of selecting chemical reactants and conditions for chemical reactions that may be used in subterranean applications. In another respect, the system and method described may be applied to affect the properties of consolidating and proppant flowback resins.

A good example of the use of reactive chemicals for oilfield services applications is the use of epoxy resins for consolidation and proppant flowback control. By way of example, one epoxy consolidating treatment system, often used, is a two-component system comprising an epoxy resin and a modified cycloaliphatic amine hardener that is diluted in methanol. After placement in a proppant pack and in the formation, the cured epoxy resin effectively acts as an adhesive to control sand production and proppant flowback.

Consolidation with a solvent-based epoxy-based resin normally involves mixing of two components on the surface and injection into an isolated formation. For example, a formation consolidation treatment may utilize an A component (epoxy resin in solvents such as butyl lactate and butyl glycidyl ether) and a B component (modified aliphatic amine adduct containing phosphate ester and methanol as the bulk solvent). A common epoxy resin used in consolidation formulations is diglycidylether bisphenol A ("DGEPA"). A number of amine hardening agents are known with the modified aliphatic amine adduct being one that has been used in oilfield services applications. Consolidation with aqueous emulsions of reactive epoxy components may also be mixed on the surface and injected into the formation. By way of example, an aqueous emulsion comprised of an A component (epoxy resin mixture emulsified in water) and a B component (a diamine mixture emulsified in water) may be mixed on the surface to provide a reactive emulsified mixture of component A and component B.

Epoxy resin-curing reactions are well known to be generally exothermic. Rickman, Wilson, and Weaver (R. D. Rickman, J. M. Wilson, and J. D. Weaver, "Kinetic Parameters for Dilute Epoxy Resins Measured via Nuclear Magnetic Resonance Spectroscopy", SPE 106160, 2007) have measured the kinetic parameters for the reactions of the components used in a typical consolidation and proppant flowback application, that is, diglycidylether bisphenol A as component A reacted with modified aliphatic amine adduct as component B. In addition to the measurement of the activation energies and the pre-exponential factors, the enthalpies and entropies of activation were calculated. The authors further state that "knowledge of certain thermodynamic properties of the resin is requisite. If the resin cures too rapidly, several problems can arise: (1) the resin can cure in the tubulars resulting in their plugging; (2) the resin may cure in the formation before having a chance to coat, thus, plugging the pore throats; or (3) the resin may cure on the proppant before fracture closure and grain-to-grain contact has been initiated; in this case, the proppant pack will not consolidate, and proppant flowback control is not assured." Rosu, Mustata, and Cascaval (D. Rosu, F. Mustata, and C. N. Cascaval, "Investigation of the Curing Reactions of Some Multifunctional Epoxy Resins Using Differential Scanning Calorimetry", Thermochimica Acta, 370, 2001, 105) studied the reaction of the epoxy resins, e.g., tetraglycidyl of diaminodiphenylmethane ("TGDDM"), tetraglycidyl of diaminodiphenylether ("TGDDE") and tetraglycidyl of diaminobibenzyl ("TGDBBz") with tetraethylene tetramine ("TETA").

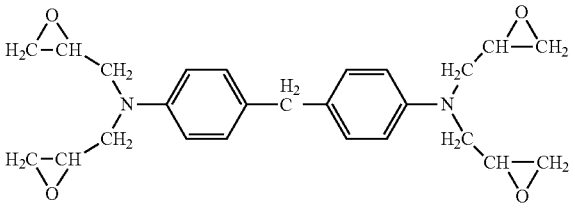

TGDDM

-continued

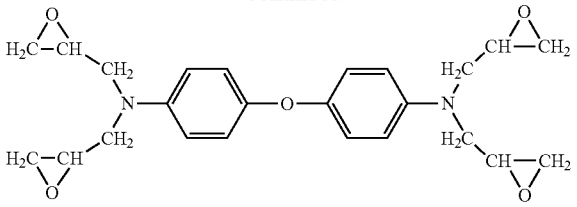

TGDDE

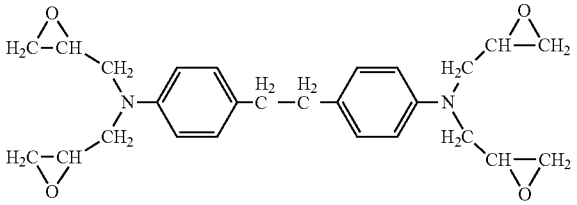

TGDBBz

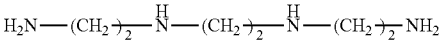

TETA

As shown below in Table 1, the curing characteristics of the TGDDM/TETA reaction were determined by differential scanning calorimetry ("DSC") as well as the curing characteristics of the TGDEE/TETA and TGDBBz/TETA epoxy curing reactions

TABLE 1

Curing Characteristics of the Epoxy Resin/TETA Mixtures at Various Heating Rates (D. Rosu, F. Mustata, and C. N. Cascaval, Thermochimica Acta, 370, 2001, 105)

| System | Heating Rate (° C./min) | $T_i$ (° C.) | $T_p$ (° C.) | $T_f$ (° C.) | Cure time (min) |
|---|---|---|---|---|---|
| TGDDM/TETA | 5 | 30 | 84 | 137 | 21.4 |
| | 10 | 31 | 95 | 142 | 11.1 |
| | 20 | 53 | 103 | 146 | 4.7 |
| TGDDE/TETA | 5 | 31 | 81 | 130 | 19.8 |
| | 10 | 34 | 89 | 143 | 10.9 |
| | 20 | 35 | 99 | 240 | 10.2 |
| TGDBB$_f$/TETA | 5 | 30 | 75 | 132 | 20.2 |
| | 10 | 40 | 83 | 145 | 7.5 |
| | 20 | 46 | 94 | 195 | 6.5 |

Padma, Rao, Subramaniam, and Nagendrappa (A. Padma, R. M. V. G. K. Rao, C. Subramaniam, and G. Nagendrappa, "Cure Characterization of Triglycidyl Epoxy/Aromatic Amine Systems", *Journal of Applied Polymer Science,* 57, 1995, 401) investigated the cure profiles and heats of reaction for triglycidyl para-aminophenol epoxy resin (TGPAP) with three amino hardening agents, that is, diaminodiphenylsulphone (DDS), pyridinediamine (PDA) and tolunediamine (TDA).

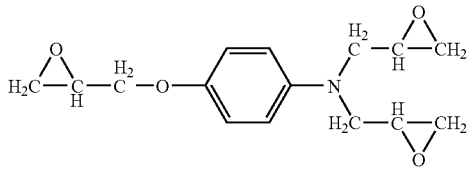

TGPAP

-continued

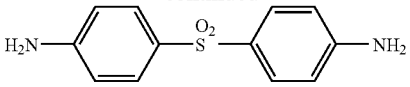

DDS

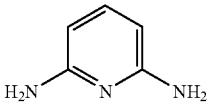

PDA

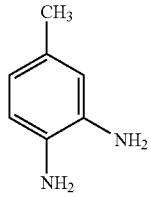

TDA

TABLE 2

Curing Characterization of Triglycidyl Epoxy/Aromatic Amine Systems (A. Padma, R. M. V. G. K. Rao, C. Subramaniam, and G. Nagendrappa, Journal of Applied Polymer Science, 57, 1995, 401)

| System | Heating Rate (°K/min) | $T_i$ (° C.) | $T_{pl}$ (° C.) | $T_f$ (° C.) | ΔH (J/g) |
|---|---|---|---|---|---|
| TGPAP/DDS | 10 | 416 | 482 | 505 | 348 |
| | 15 | 414 | 488 | 504 | 352 |
| | 20 | 412 | 495 | 510 | 368 |
| TGPAP/PDA | 10 | 378 | 478 | 485 | 339 |
| | 15 | 377 | 485 | 515 | 353 |
| | 20 | 379 | 491 | 520 | 352 |
| TGPAP/TDA | 10 | 331 | 380 | 476 | 280 |
| | 15 | 334 | 390 | 491 | 251 |
| | 20 | 331 | 402 | 493 | 262 |

The temperature profiles, cure times, and heats of reaction shown in Table 1 and Table 2 demonstrate that the epoxy/amine reaction may be sufficiently exothermic to follow and monitor in subterranean environments.

Others have used thermoanalytical methods such as DSC to study the epoxy/amine reaction. Um, Daniel, and Hwang (M.-K. Um, I. M. Daniel, and B.-S. Hwang, "A Study of Cure Kinetics by the Use of Dynamic Differential Scanning Calorimetry", *Composites Science and Technology,* 62, 2002, 29) provide a new method for modeling mold filling and resin cure to optimize manufacturing processes involving thermosetting composites. Kinetics parameters for epoxy-amine reactions were determined with differential scanning calorimetry (C. W. Wise, W. D. Cook, and A. A. Goowin, "Chemico-Diffusion Kinetics of Model Epoxy-Amins Resins", Polymer, 38 (13), 1997, 3261). Maity, Samanta, Dalai, and Banthia (T. Maity, B. C. Samanta, S. Dalai, and A. K. Banthia, "Curing Study of Epoxy Resin by New Aromatic Amine Functional Curing Agents Along with Mechanical and Thermal Evaluation", *Materials Science and Engineering A,* 464, 2007, 38) have extensively studied the curing reactions by a number of analytical techniques including DSC. The DSC data was used to evaluate the curing rate and extent of curing as a function of time Extent of conversion upon injection into a formation is a critical parameter in consolidation and proppant flowback resins. It proposed herein that calorimetric techniques be used to evaluate the extent of conversion in placement of these consolidation resins by the coupling of classical calorimetric techniques and data with distributed temperature systems for subterranean applications.

Distributed temperature sensing ("DTS") has been applied by Glasbergen, Gualtieri, van Domelen, and Sierra (G. Glasbergen, D. Gualtieri, M. van Domelen, and J. Sierra, "Real-Time Fluid Distribution Determination in Matrix Treatments Using DTS", SPE 107775, 2007) to obtain real-time fluid distribution during a matrix treatment. Also, contained in this publication is a DTS overview in which use in downhole applications is explained. A real-time numerical temperature model that incorporates downhole factors such as convection, conduction, and fluid friction was developed Distributed Temperature Sensing ("DTS") by use of an optical fiber fundamentally relies on light scattering to assess temperature differences along the optical fiber. An optical laser transmits light down the optical glass fiber. A fraction of light is back-scattered by the fiber material back through the fiber to a detection system near the laser source.

When light is transmitted down the fiber, it is scattered in elastic and non-elastic ways by interaction with the glass material. Elastic scattering, also known as Raleigh scattering, simply results in the change in direction of the light with no change in frequency or energy. Non-elastic scattering, known as Raman scattering, changes not only the direction of the light but also its frequency and energy. In Raman scattering, the reflected light may be lower in energy and is usually referred to Stokes lines in the spectrum of reflected light). Whereas, in Raman scattering, the reflected light that is higher in energy is referred to as anti-Stokes lines. Stokes lines have little dependence on the temperature of the optical fiber. On the other hand, the anti-Stokes lines are dependent of the temperature of the optical fiber.

The spectrum of back-scattered light within the optical fiber comprises light from Raleigh scattering as well as from Raman scattering (Stokes and anti-Stokes lines). In back-scattered light within the optical fiber, the temperatures along the optical fiber may be determined as a function of the Stokes (little temperature dependence) and anti-Stokes (temperature-dependent) lines. The distance of the temperature along the fiber is calculated by simply a time of flight measurement. That is, the time it takes for the scattered light to reach the detection unit may be used with the speed of light to calculate the location of temperature along the optical fiber. DTS measurements for temperatures may be calibrated by an independently measured temperature at the surface or at any depth in the wellbore By incorporating reaction modeling into the temperature fluid modeling described above, it is possible to estimate and determine the extent of chemical reactions in subterranean applications, thereby allowing the selection of chemical reactions and treatment conditions.

Laboratory or field calorimetric measurements of the chemical reactions under conditions to be utilized for the subterranean applications provide the basic data for input into the reaction model. Literature calorimetric data involving closely-related compounds may also be utilized in the reaction model to estimate and determine the extent of the chemical reaction.

Again, by way of example, epoxy-resin based consolidation reactions have been extensively studied in the laboratory. FIG. 1 shows a typical example of such a reaction of a diepoxide with a diamine to form an epoxy resin. Kinetic and thermodynamic parameters and related temperature profiles are well known under a variety of conditions. This fundamental laboratory data may now be used in a reaction model to predict the temperature profiles in the wellbore to facilitate the optimal conversations needed as the resin composition is injected into the formation.

The calorimetric distributed temperature system also requires the resolution or at least the understanding of reaction heat effects on downhole DTS measurements from the baseline fluid effects on DTS measurements. The DTS system may be utilized to interrogate and understand the thermal downhole environment of a particular well. This thermal profile information may then be used to model the actual thermal environment that a resin solution would be subjected to upon injection into a wellbore. Such a thermal profile would include and incorporate the DTS data from that particular well, the fluid modeling approach as defined by Glasbergen et al., and the placement design data such as injection rates and equipment parameters.

With the thermal profile defined, additional information such as concentrations and solvent-effect data may then be input into a reaction model to predict the percent conversion or extent of reaction for any particular placement. In addition to extent of reaction, the reaction model would be used to predict the temperature increase that should be observed in the near-wellbore region. DTS could then be used to verify fluid and reaction modeling results. Any reaction used in subterranean formations that is not thermoneutral may be subject to the verification according to the system and method as described herein.

Thus, in one embodiment, the resin reaction data could be expanded by laboratory experimentation to include a full range of concentrations and temperatures (and optionally for catalyst concentrations if catalysts are used). This data would be used to develop a robust reaction model to predict parameter such as conversion (extent of reaction) for a placement in a specific formation. The reaction model would take into account the equipment variables that are dependent on the placement equipment/technique and the DTS data for that particular well. Desired percent conversion (extent of reaction) could then be affected by adjustments in component concentrations, temperature adjustment in the mixing/blending operations, types of catalysts, or catalyst concentrations adjustments (if catalysts are used).

In another embodiment, the DTS and fluid modeling data could be used to carry out field DSC tests to determine the resin solution parameters of component concentrations, initial injection temperatures, and optionally types of catalysts and the catalyst concentrations.

Depending upon the service to be provided, differing conversions would be needed to affect resin performance. That is, near-wellbore consolidation services may require high conversion (extent of reaction) in the isolated zone as the resin solution exists the placement equipment, whereas, to extend formation consolidation far from the wellbore, relatively lower conversions may be desired as the resin solution enters the formation.

Placement of consolidation resins in formations is currently based upon general experimental data, and specific wellbore temperature profile and placement parameters are not utilized for consolidation services. This invention would allow resin component concentrations, injection temperatures, types of catalysts, and catalyst concentrations to be adjusted for required resin performance through fluid and reaction modeling approaches. Fluid and reaction models could then be validated and improved by DTS data from actual consolidation services data.

Methods according to the invention can provided reduced sand production and increased conductivity by improved consolidation treatment by customized services or reduced costs by more effective use of resin components.

The forgoing description supports several methods and applications according to the invention.

According to one aspect of the invention, a method is provided including the steps of: (a) obtaining wellbore temperature-profile information; (b) obtaining kinetic information of the extent of the chemical reaction over time under at least one test temperature profile for a test fluid comprising reactants for the chemical reaction; (c) analyzing at least the wellbore temperature-profile information and the kinetic information: (i) to help design the composition of the treatment fluid, or (ii) to help design a treatment set of introducing conditions for introducing the treatment fluid through the wellbore into the subterranean formation; and (d) introducing the treatment fluid through the wellbore into the subterranean formation according to the treatment set of introducing conditions. This method may further comprise the steps of: (a) measuring the treatment temperature-profile for the treatment fluid when it is introduced through the wellbore into the subterranean formation under the treatment set of introducing conditions; (b) obtaining heat-of-reaction information for the chemical reaction; (c) analyzing at least the wellbore temperature-profile information, the treatment temperature-profile information, and the heat of reaction to help estimate the extent of the chemical reaction as the fluid enters the subterranean formation and to help design a minimum residence time for the treatment fluid in the subterranean formation at the temperature of the subterranean formation to allow for at least a desired percent completion of the chemical reaction; and (d) maintaining at least a sufficient pressure on the subterranean formation to provide at least the designed minimum residence time.

According to another aspect of the invention, a method is provided including the steps of: (a) obtaining wellbore temperature-profile information; (b) obtaining kinetic information of the extent of the chemical reaction over time under at least one test temperature profile for a test fluid comprising the reactants for the chemical reaction; (c) analyzing at least the wellbore temperature-profile information and the kinetic information to help design a minimum residence time for the treatment fluid in the subterranean formation at the temperature of the subterranean formation to allow for at least a desired percent completion of the chemical reaction; (d) introducing the treatment fluid through the wellbore into the subterranean formation under a treatment set of introducing conditions; and (e) shutting-in the well to provide at least the designed minimum residence time. This method may further comprise the steps of: (a) measuring the treatment temperature-profile for the treatment fluid when it is introduced through the wellbore into the subterranean formation under the treatment set of introducing conditions; and (b) obtaining heat-of-reaction information for the chemical reaction; wherein the step of analyzing further comprises analyzing with the treatment temperature-profile information and the heat-of-reaction information.

According to yet another aspect of the invention, a method is provided including the steps of: (a) obtaining wellbore temperature-profile information; (b) measuring the treatment temperature-profile for the treatment fluid when it is introduced through the wellbore into the subterranean formation under the treatment set of introducing conditions; (c) obtaining heat-of-reaction information for the chemical reaction; (d) analyzing at least the wellbore temperature-profile information, the treatment temperature-profile information, and the heat of reaction to help estimate the extent of the chemical reaction as the fluid enters the subterranean formation and to help design a minimum residence time for the treatment fluid in the subterranean formation at the temperature of the subterranean formation to allow for at least a desired percent completion of the chemical reaction; and (e) shutting-in the well to provide at least the designed minimum residence time. This method may further comprise the step: obtaining kinetic information of the extent of the chemical reaction over time under at least one test temperature profile for a test fluid comprising the reactants for the chemical reaction; wherein the step of analyzing further comprises analyzing with the kinetic information.

As used herein, the words "include," "comprise," "has," and all grammatical variations thereof are each intended to have an open, non-limiting meaning that does not exclude additional steps, elements, ingredients, or materials.

Oil and gas hydrocarbons are naturally occurring in some subterranean formations, which are called reservoirs. As used herein, a well includes at least one wellbore drilled into the earth to try and reach an oil or gas reservoir and produce oil or gas from the reservoir. It should be understood, of course, a well can be based on land or offshore at sea.

As used herein, the term "wellbore" refers to the wellbore itself, including the openhole or uncased portion of the well. Further, as used herein, "into the wellbore" means and includes directly into and through the wellbore or into and through a casing, liner, or other tubular within the wellbore. The near-wellbore region is the subterranean material and rock of the subterranean formation surrounding the wellbore.

As used herein, the term "treatment operation" means and includes any treatment process or operation performed on a subterranean formation penetrated by a wellbore. For example, the treatment operation can include placing a curable resin into the subterranean formation where the treatment fluid comprises the reactants for the curable resin. By way of another important example, the treatment operation can include fracturing the subterranean formation where the reactant of the treatment fluid includes a breaker for the chemical reaction of breaking the viscosity of a polymeric material of the treatment fluid. Another example includes the use of fluid comprising a delayed-release acid that chemically decomposes to release an acid. As used herein, a "delayed-release acid" means and includes any compound(s) which will decompose to release acid. An example of a delayed-release acid is polylactic acid. For yet another important example according to the invention, a treatment operation can include a cementing operation, where the rate of curing of the cement can be predicted or monitored.

As used herein, a "treatment fluid" is a fluid designed and prepared to resolve a specific wellbore or reservoir condition. The treatment fluid may be for any of a wide variety of downhole purposes in a well, such as cementing, stimulation, isolation, or control of reservoir gas or water. The term "treatment" in the term "treatment fluid" does not necessarily imply any particular action by the fluid. As used herein, a fluid may or may not be a slurry, which is a suspension of insoluble particles (such as sand, clay, etc.) in a fluid. As used herein, a fluid may or may not be an emulsion, which is a suspension of one liquid in another liquid. As used herein, a fluid may or may not be a foam, which is a suspension of a gas in a liquid. The treatment fluids are often, but not necessarily, water based. It should be understood from the context of these inventions, of course, that as used herein a "fluid" is a continuous amorphous substance that tends to flow and to conform to the outline of its container as a liquid or a gas, when tested at a temperature 68° F. (20° C.) and standard pressure (1 atm).

In general, it should be understood that a "chemical reaction" means any process comprising the breaking or making of chemical bonds including a dissociation, recombination, or rearrangement of atoms. For example, a combination reaction is a reaction in which two or more substances are chemically bonded together to produce a product; isomerization is a chemical change that involves a rearrangement of atoms and bonds within a molecule, without changing the molecular formula. A decomposition or degradation reaction is a reaction in which a compound is broken down into simpler compounds or elements. For example, some compounds decompose if heated. A displacement reaction is a reaction in which a fragment of one reactant is replaced by another reactant (or by a fragment of another reactant). For example, a displacement reaction can include either a single displacement or a double displacement. A reaction can be a combustion reaction between a fuel and an oxidizer in which case the reaction produces also produces heat or light.

A "reactant" is a chemical substance that is present at the start of a chemical reaction and is consumed during a chemical change. As used herein, "the reactants" for a chemical reaction means and includes either the single reactant in the case of a rearrangement or isomerization reaction or the two or more different reactants in the case of a combination reaction. In chemistry, a "catalyst" is a substance that increases the rate of a chemical reaction, without being consumed or produced by the reaction. Catalysts speed both the forward and reverse reactions, without changing the position of equilibrium. A "product" is a chemical substance that is produced during a chemical change.

As used herein, unless otherwise further specified, "obtaining" information includes by referencing published information on the subject matter. In the case of information about wellbore conditions, "obtaining" includes referencing the particular history or measurements of the well or by extrapolating from the history or measurements of other wells in the field or for other wells in a similar field. In the case information about a chemical reaction, including kinetic or thermodynamic information, "obtaining" includes by referencing published reaction data or by making field or laboratory measurements. Further, "obtaining" information can include by estimation, interpolation, or extrapolation from actual data or measurements to the desired information.

Formation temperature-profile-means the temperature information as it varies along the wellbore from a wellhead to the subterranean formation. The more accurate the formation temperature-profile information, the more accurate modeling of temperature effects on the kinetics of a chemical reaction to be introduced through the wellbore.

The temperature-profile information for a wellbore is referred to as "wellbore temperature-profile information." The most rudimentary temperature-profile information for a wellbore at thermal equilibrium or a static state includes rule-of-thumb estimates based on the depth of the wellbore. In an embodiment, the temperature-profile information is obtained by making measurements along the wellbore at a plurality of locations. According to the presently-most preferred embodiment of the invention, the wellbore temperature-profile information is obtained by DTS.

The temperature-profile information for a treatment fluid when it is introduced through the wellbore into the subterranean formation under the treatment set of introducing conditions is referred to as "treatment temperature-profile information." Similarly, the temperature-profile information for another fluid, such as a "first fluid" or a "second fluid" used to help obtain temperature-profile information on a reference fluid introduced through the wellbore, which according to the invention can be useful as background or reference in the modeling of the thermal conditions as a fluid moves through the wellbore may be referred to, for example, as "first temperature-profile information" or "second temperature-profile information." Various techniques may be used to measure the treatment temperature-profile information. This temperature-profile information may be measured by a plurality of temperature sensors along the wellbore. At least a plurality of temperature measurements is required. The more sensors employed and the more accurate each of the sensors is, however, the more accurate the measured temperature-profile information. According to the presently-most preferred embodiment of the invention, the temperature-profile information for a fluid as it is introduced through the wellbore is measured with DTS.

Figure 2:
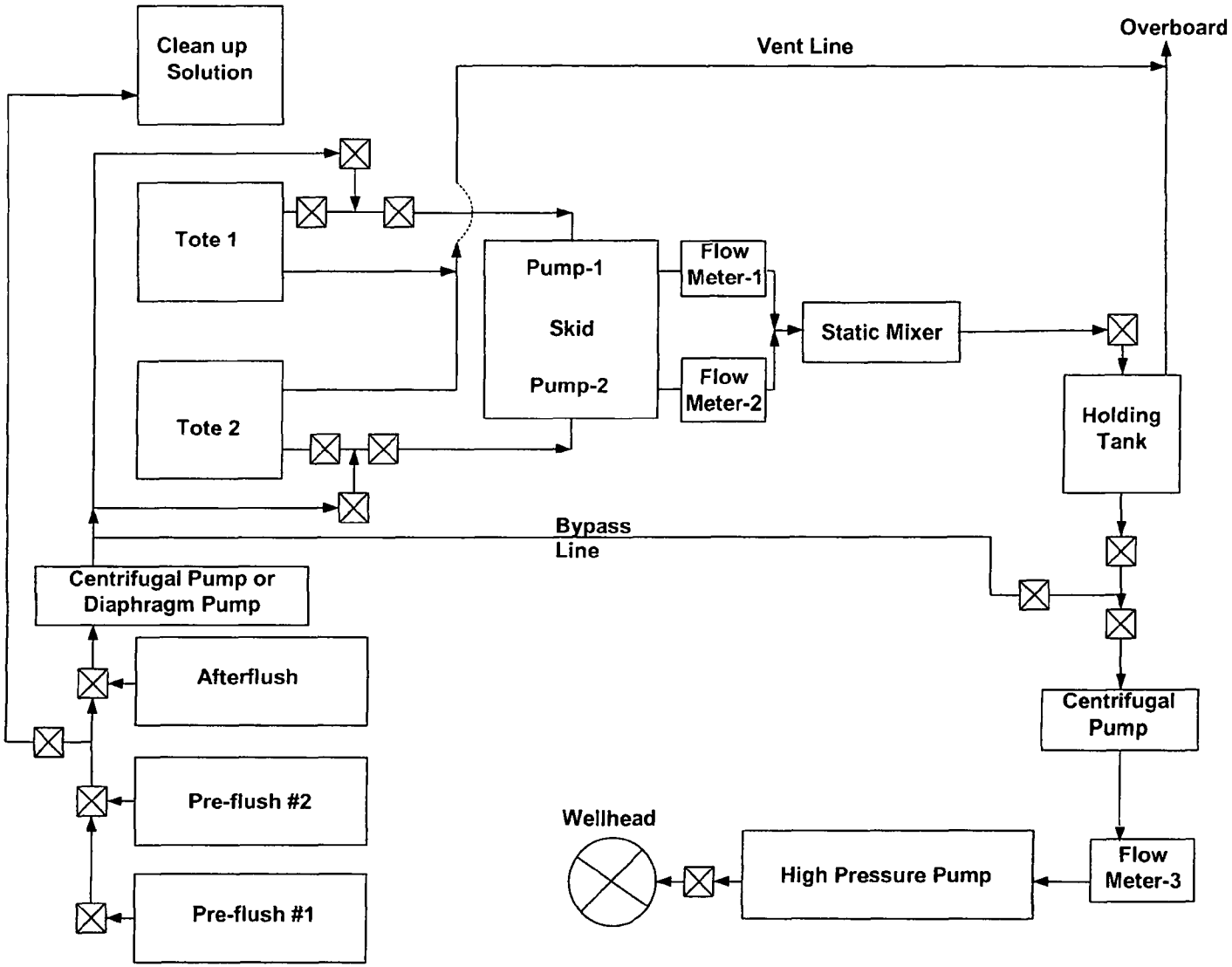
FIG. 2 shows the a diagram of surface equipment for injection of a two-part resin system into a subterranean formation

"Introducing" a fluid through a wellbore and into a subterranean formation includes pumping and directing the fluid. See the FIG. 2 for a typical oilfield operational process for placement of an epoxy consolidating agent. The epoxide resin is placed in Tote 1 and the hardener is placed in Tote 2. The two component solutions are pumped, respectively by pumps LA-1 and LA-2, and monitored/controlled by flow meters, respectively by flow meters FM-1 and FM-2. The epoxide and hardener solutions are then blended together (simple T) and mixed in a short static mixer. The reaction mixture begins to react at the point of combining the solutions at the T. The reacting solution then passes through a holding tank (optional) and again metered by a centrifugal pump and a solution flow meter (FM-3) to the high pressure pumps (e.g., HT-400 Pumps). Finally, the reacting solution flows to the well, down the tubulars, and ultimately into the formation.

The pumping of the fluid can be on the separate fluid streams used to make up the fluid or on the completely-formed fluid. The directing of the fluid into a wellbore can be on the separate fluid streams or on the completely-formed fluid. The merging of separate fluid streams to make up the fluid may take place, for example, as the separate fluid streams are directed toward the wellbore, as they enter into the wellbore, or as they move through the wellbore. Directing a fluid stream is typically accomplished with piping or other tubulars and may include the use of downhole isolation tools or techniques. Separate streams of pumped fluid can be merged by using, for example, one or more manifolds.

As used herein, "introducing conditions" includes at least the pumping rate. In addition, "introducing conditions" includes the initial temperature of the fluid when it is introduced into the wellbore. According to the inventions, it is contemplated that the "introducing conditions" may be further controlled by adjusting the temperature of the fluid before it enters the wellbore. For example, a heat exchanger may be employed to lower the initial temperature of the fluid, which would tend to slow the rate of any chemical reactions taking place in the fluid as it is introduced through the wellbore. According to the invention, the methods can predict the effect of adjusting the initial temperature of the fluid on the rate of reaction or can measure resulting temperature differences as the fluid goes downhole for estimating the effect of adjusting the initial temperature of the fluid on the percent completion of the reaction.

Methods according to the invention can be used to design the composition of a treatment fluid, for example, by selecting the concentrations of the reactants or any catalyst employed in a chemical reaction to help control the extent of the reaction under the predicted treatment temperature-profile. The extent of the reaction can then be followed to confirm whether or not the reaction proceeded as predicted, which information can also be used to help design residence time for the treatment operation or design future treatment operations, including treatment operations for other wells. In general, the inventions may include a step of forming a treatment fluid for use in a treatment operation. As used herein, "forming" a fluid includes mixing or merging two or more fluids or a fluid with a powdered or particulate material, such as a powdered dissolvable or hydratable additive (prior to hydration) or a proppant. In a continuous treatment or in a continuous part of a well treatment, the fluids are handled as fluid streams.

In general, it is desirable to minimize the extent of a chemical reaction prior to the fluid carrying the reactants entering a subterranean formation. The purpose is to have the chemical reaction take place in the formation, not before it reaches the formation. Similarly, the residence time for a treatment fluid in the subterranean formation should be at least sufficient to allow for at least a desired percent completion of the chemical reaction in the formation prior to flowing back fluid from the formation and back through the wellbore. Methods according to the invention can be advantageously employed to know the extent of a reaction prior to entering the formation and to design minimum residence time in the formation. Preventing fluids from flowing back from a formation is sometimes referred to as "shutting-in" the formation. Generally, so long as a sufficient pressure is maintained on the subterranean formation, which can be accomplished by a variety of methods known to those of skill in the art, a treatment fluid will remain in the formation. As a general rule-of-thumb, it is desirable to maximize the utilization of the reactants of a chemical reaction within the formation. As used herein, a desired percent completion means at least 50% completion.

Designing a composition of a treatment fluid, a treatment set of introducing conditions, or a minimum residence time means selecting or adjusting the composition, conditions, or time, respectively.

It should be understood that as used herein, "first" and "second," may be arbitrarily assigned and are merely intended to differentiate between two or more fluids, sets of data, introducing conditions, etc., as the case may be. Furthermore, it is to be understood that the mere use of the term "first" does not require that there be any "second," and the mere use of the word "second" does not require that there by any "third," etc.

Obtaining Wellbore Temperature-Profile Information

According to one aspect of the invention, the step of obtaining wellbore temperature-profile information comprises measuring the wellbore temperature-profile information using DTS.

Obtaining First Temperature-Profile Information on a First Fluid

It can be particularly useful if the wellbore temperature-profile information further includes first-temperature profile information for a first fluid introduced through the wellbore into the subterranean formation under a first set of introducing conditions. This can provide background or reference information useful for help building a model of the thermal environment of the particular wellbore. The step of obtaining the first temperature-profile information can include reviewing well records or it can include a step of introducing the first fluid through the wellbore into the subterranean formation according to the first set of introducing conditions.

According to certain embodiments of the methods according to the invention, the first fluid does not comprise at least one of the reactants of the chemical reaction or does not comprise any catalyst for the chemical reaction such that the chemical reaction does not occur when the first fluid is introduced through the wellbore and into the subterranean formation. This may be useful, for example, in using a DTS temperature profile of a treatment fluid to observe the progress of the reaction in the treatment fluid. Preferably, the first fluid has a heat capacity similar to the heat capacity of the treatment fluid. Preferably, the first fluid has a heat-transfer coefficient that similar to the heat-transfer coefficient of the treatment fluid, wherein the heat-transfer coefficients are determined under the same heat-transfer test conditions. Preferably, the first set and the treatment set of introducing conditions each comprises the same fluid pumping rate. More preferably, the treatment set of introducing conditions is the same in all material respects as the first set of introducing conditions. These similarities can be useful in making analytical comparisons between the first fluid and a treatment fluid. For example, this makes the treatment temperature-profile information and the first temperature-profile information more directly comparable.

According to the invention, the step of analyzing preferably comprises the step of using the first temperature-profile information to create a model of the thermal conditions that the first fluid is subjected to when the first fluid is introduced through the wellbore into the formation under the first set of introducing conditions.

Obtaining Second Temperature-Profile Information on a Second Fluid

The methods according to the invention preferably further comprise the step of: obtaining second temperature-profile information for a second fluid introduced through the wellbore into the subterranean formation under a second set of introducing conditions, wherein: (i) at least the second fluid is different from the first fluid; or (ii) at least the second set of introducing conditions is different from the first set of introducing conditions; wherein the step of analyzing preferably comprises using the second temperature-profile information to create a model of the thermal conditions to which the first fluid and the second fluid are subjected to when introduced through the wellbore into the formation under the first and second sets of introducing conditions, respectively. According to this embodiment of the methods, more preferably, the second fluid does not comprise at least one of the reactants of the chemical reaction or does not comprise any catalyst for the chemical reaction such that the chemical reaction does not occur when the second fluid is introduced through the wellbore and into the subterranean formation. This additional information improves the modeling of the thermal conditions for a fluid introduced through the wellbore into the subterranean formation.

Obtaining Kinetic Information on the Chemical Reaction

Preferably, the kinetic information for a chemical reaction should be obtained across the range of the wellbore temperature-profile information. Preferably, the kinetic information includes a temperature-dependent rate constant. As the kinetics of a reaction can also be dependent on solvent effects, the rate constant should be in a comparable solvent or the rate constant should be adjusted for solvent effects. Preferably, the kinetic information of a reaction is closely comparable to the composition of the treatment fluid and the temperature conditions to which it is subjected when introduced through a wellbore into a subterranean formation.

The step of obtaining kinetic information on the chemical reaction preferably comprises: obtaining kinetic information for a test fluid comprising the reactants for the chemical reaction that is subjected to at least one test temperature profile that includes the temperature range of the wellbore temperature-profile information. The reaction kinetics can include, for example, the reaction of an acid in a formation with known mineralogy. These kinetics are largely temperature dependent and temperature effects can be measured in the lab; the temperatures for a designed treatment can be predicted by the numerical temperature model and the reaction to the formation can be predicted; the formulation can be altered based on such information and the reaction kinetics of the reaction. Preferably, the test fluid comprises the same solvent environment as for the treatment fluid. The reaction kinetics can include, for example, solvent effects on the reaction. For example, the process can include collecting sample data of the material to be solved in a wellbore or formation, collecting temperature data potentially using DTS, predicting the wellbore temperature during injection, measuring the kinetics of a solvent to the to be solved material and optimizing the formulation of the solvent to the anticipated temperature.

According to another embodiment, the step of obtaining kinetic information further comprises obtaining kinetic information by varying the test temperature profile and the initial concentration of at least one of the reactants of the chemical reaction.

According to yet another embodiment of the methods according to the invention, the step of obtaining kinetic information further comprises: including fluid a catalyst for the chemical reaction in the test fluid. More preferably, the step of obtaining kinetic information further comprises varying at least the catalyst type and concentration of the catalysts.

It should be understood that kinetic information can be measured with a variety of laboratory techniques, including calorimetric, spectrographic, and chromatographic techniques known to those skilled in such art. According to an embodiment of this invention, the kinetic information can be measured using differential scanning calorimetry, which can also provide the heat of reaction.

Analyzing the Temperature-Profile Information and the Kinetic Information to Design Treatment According to an embodiment of the methods, the step of analyzing comprises graphically comparing the kinetic information to the wellbore temperature-profile information. More preferably, the step of analyzing comprises computer analysis.

Designing and Introducing a Second Treatment Fluid or Introducing Conditions

According to another preferred embodiment of the invention, the methods further comprise the step of: (a) analyzing the wellbore temperature-profile information, the treatment temperature-profile information, and the kinetic measurements data: (i) to help design the composition of a second treatment fluid, or (ii) to help design a second treatment set of introducing conditions for introducing the second treatment fluid through the wellbore into the subterranean formation; and (b) introducing the second treatment fluid through the wellbore and into the subterranean formation according to the second treatment introducing conditions.

Mathematical Modeling

More specifically, a mathematical model is a description of a physical, chemical, or biological state or process. Using a model helps understand the processes or mechanisms involved, enabling one to design better experiments or processes and make better sense of the results. A mathematical model can be used to describe a process in time and space. In other words, processes can be simulated in the time and space domain with the aid of mathematical modeling.

For example, in simplest form, a model relates two variables with a straight line on a graph. This is known as linear regression. Y equals a slope times X plus an intercept. The model can be fit to a set of data using linear regression to determine the best-fit values of the slope and intercept. More precisely, linear regression finds values for the slope and intercept that define the line that minimizes the sum of the square of the vertical distances between the points and the line. The equations used to do this can be derived with no more than high-school algebra. The best-fit values can be interpreted in the context of the model. For example, one can determine rate constants, equilibrium constants, etc. Linear regression is the simplest because the math is so simple and one can compute the best-fit values of slope and intercept by hand on paper. Other models require much more difficult calculations, usually performed with the aide of a computer, but the idea is the same.

Many relationships in chemistry (and other fields of science) do not follow a straight line. To analyze such data, one has two basic choices: to do mathematical transformations to force the data into a linear relationship and then use linear regression, or to use nonlinear regression. The results obtained by doing mathematical transformations are less accurate than nonlinear regression, however.

Nonlinear regression is a general technique to fit a curve through a set of data. It fits data to any equation that defines Y as a function of X and one or more parameters. It finds the values of those parameters that generate the curve that comes closest to the data (minimizes the sum of the squares of the vertical distances between data points and curve). Except for a few special cases, it is not possible to directly derive an equation to compute the best-fit values from the data. Instead, nonlinear regression requires a computationally intensive, iterative approach.

Choosing a mathematical model for a process is a scientific decision. It should be based on the best understanding of the science of the process. Persons of skill in the art will appreciate the science of the various chemical reactions and treatment processes according to this invention and various mathematical modeling techniques for analyzing sets of data.

Preferably, two or more aspects of the invention or preferred embodiments are used together or in subcombination to obtain combined methods and synergistic benefits, advantages, and costs savings.

Methods of the present invention are well adapted to carry out the objects and attain the ends and advantages discussed above as well as those inherent therein. While preferred embodiments of the inventions have been described for the purpose of this disclosure, changes in the sequence of steps and the performance of steps can be made by those skilled in the art, which changes are encompassed within the spirit of this invention as defined by the appended claims.

What is claimed is:

1. A method for designing and performing a treatment operation on a subterranean formation penetrated by a wellbore, wherein the treatment operation includes the use of a treatment fluid comprising reactants for a chemical reaction, the method comprising the steps of:

(a) obtaining wellbore temperature-profile information;

(b) obtaining kinetic information of the extent of the chemical reaction over time under at least one test temperature profile for a test fluid comprising the reactants for the chemical reaction;

(c) analyzing at least the wellbore temperature-profile information and the kinetic information:

(i) to help design the composition of the treatment fluid, or (ii) to help design a treatment set of introducing conditions for introducing the treatment fluid through the wellbore into the subterranean formation; and (d) introducing the treatment fluid through the wellbore into the subterranean formation according to the treatment set of introducing conditions;

(e) measuring the treatment temperature-profile for the treatment fluid when it is introduced through the wellbore into the subterranean formation under the treatment set of introducing conditions;

(f) obtaining heat-of-reaction information for the chemical reaction;

(g) analyzing at least the wellbore temperature-profile information, the treatment temperature-profile information, and the heat of reaction to help estimate the extent of the chemical reaction as the fluid enters the subterranean formation and to help design a minimum residence time for the treatment fluid in the subterranean formation at the temperature of the subterranean formation to allow for at least a desired percent completion of the chemical reaction; and (h) shutting-in the well to provide at least the designed minimum residence time.

2. The method according to claim 1, wherein the step of obtaining kinetic information further comprises obtaining kinetic information for a test fluid comprising the reactants for the chemical reaction that is subjected to at least one test temperature profile that includes the temperature range of wellbore temperature-profile information.

3. The method according to claim 1, wherein the step of obtaining kinetic information further comprises obtaining kinetic information varying the test temperature profile or the initial concentration of at least one of the reactants of the chemical reaction.

4. The method according to claim 1, wherein the step of obtaining kinetic information further comprises including in the test fluid a catalyst for the chemical reaction.

5. The method according to claim 4, wherein the step of obtaining kinetic information further comprises varying at least the concentration of the catalyst.

6. The method according to claim 1, wherein the step of analyzing comprises graphically comparing the kinetic information to the wellbore temperature-profile information.

7. The method according to claim 1, wherein the step of analyzing further comprises creating a model of the thermal conditions that the treatment fluid is expected to be subjected to when the treatment fluid is introduced through wellbore into the formation under the treatment set of introducing conditions.

8. The method according to claim 1, wherein the step of analyzing comprises computer analysis.

9. The method according to claim 1, further comprising the steps of:

(a) analyzing the wellbore temperature-profile information, the treatment temperature-profile information, and the kinetic measurements data: (i) to help design the composition of a second treatment fluid, or (ii) to help design a second treatment set of introducing conditions for introducing the second treatment fluid through the wellbore into the subterranean formation; and (b) introducing the second treatment fluid through the wellbore and into the subterranean formation according to the second treatment introducing conditions.

10. A method for designing and performing a treatment operation on a subterranean formation penetrated by a wellbore, wherein the treatment operation includes the use of a treatment fluid comprising reactants for a chemical reaction, the method comprising the steps of:

(a) obtaining wellbore temperature-profile information;

(b) obtaining kinetic information of the extent of the chemical reaction over time under at least one test temperature profile for a test fluid comprising the reactants for the chemical reaction;

(c) analyzing at least the wellbore temperature-profile information and the kinetic information:

(i) to help design the composition of the treatment fluid, or (ii) to help design a treatment set of introducing conditions for introducing the treatment fluid through the wellbore into the subterranean formation; and (d) introducing the treatment fluid through the wellbore into the subterranean formation according to the treatment set of introducing conditions;

wherein the treatment operation comprises placing a curable resin into the subterranean formation, and the treatment fluid comprises the reactants for the curable resin.

11. A method for designing and performing a treatment operation on a subterranean formation penetrated by a wellbore, wherein the treatment operation includes the use of a treatment fluid comprising reactants for a chemical reaction, the method comprising the steps of:

(a) obtaining wellbore temperature-profile information;

(b) obtaining kinetic information of the extent of the chemical reaction over time under at least one test temperature profile for a test fluid comprising the reactants for the chemical reaction;

(c) analyzing at least the wellbore temperature-profile information and the kinetic information:

(i) to help design the composition of the treatment fluid, or (ii) to help design a treatment set of introducing conditions for introducing the treatment fluid through the wellbore into the subterranean formation; and (d) introducing the treatment fluid through the wellbore into the subterranean formation according to the treatment set of introducing conditions;

wherein the treatment operation comprises fracturing the subterranean formation, and one of the reactants of the treatment fluid comprises a breaker for the chemical reaction of breaking the viscosity of a polymeric material.

12. A method for designing and performing a treatment operation on a subterranean formation penetrated by a wellbore, wherein the treatment operation includes the use of a treatment fluid comprising reactants for a chemical reaction, the method comprising the steps of:

(a) obtaining wellbore temperature-profile information;

(b) obtaining kinetic information of the extent of the chemical reaction over time under at least one test temperature profile for a test fluid comprising the reactants for the chemical reaction;

(c) analyzing at least the wellbore temperature-profile information and the kinetic information:

(i) to help design the composition of the treatment fluid, or (ii) to help design a treatment set of introducing conditions for introducing the treatment fluid through the wellbore into the subterranean formation; and (d) introducing the treatment fluid through the wellbore into the subterranean formation according to the treatment set of introducing conditions;

wherein the treatment operation comprises the use of a treatment fluid comprising a delayed-release acid that chemically decomposes to release acid.

13. A method for designing and performing a treatment operation on a subterranean formation penetrated by a wellbore, wherein the treatment operation includes the use of a treatment fluid comprising reactants for a chemical reaction, the method comprising the steps of:

(a) obtaining wellbore temperature-profile information;

(b) obtaining kinetic information of the extent of the chemical reaction over time under at least one test temperature profile for a test fluid comprising the reactants for the chemical reaction;

(c) analyzing at least the wellbore temperature-profile information and the kinetic information:

(i) to help design the composition of the treatment fluid, or (ii) to help design a treatment set of introducing conditions for introducing the treatment fluid through the wellbore into the subterranean formation; and (d) introducing the treatment fluid through the wellbore into the subterranean formation according to the treatment set of introducing conditions;

wherein the treatment set of introducing conditions comprises a heat exchanger to lower the initial temperature of the treatment fluid, whereby the rate of reaction through the wellbore is slowed.

14. A method for designing and performing a treatment operation on a subterranean formation penetrated by a wellbore, wherein the treatment operation includes the use of a treatment fluid comprising reactants for a chemical reaction, the method comprising the steps of:

(a) obtaining wellbore temperature-profile information;

(b) obtaining kinetic information of the extent of the chemical reaction over time under at least one test temperature profile for a test fluid comprising the reactants for the chemical reaction;

(c) analyzing at least the wellbore temperature-profile information and the kinetic information:

(i) to help design the composition of the treatment fluid, or (ii) to help design a treatment set of introducing conditions for introducing the treatment fluid through the wellbore into the subterranean formation; and (d) introducing the treatment fluid through the wellbore into the subterranean formation according to the treatment set of introducing conditions;

wherein the method further comprises obtaining first temperature-profile information for a first fluid introduced through the wellbore into the subterranean formation according to a first set of introducing conditions, and wherein the step of analyzing further comprises using the first temperature-profile information to create a model of the thermal conditions to which the first fluid are subjected to when introduced through the wellbore into the formation under the first set of introducing conditions.

15. The method according to claim 14, wherein the first fluid does not comprise at least one of the reactants of the chemical reaction or does not comprise any catalyst for the chemical reaction such that the chemical reaction does not occur when the first fluid is introduced through the wellbore and into the subterranean formation.

16. The method according to claim 15, wherein the first set and the treatment set of introducing conditions each comprises the same fluid pumping rate.

17. The method according to claim 16, wherein the treatment set of introducing conditions is the same as the first set of introducing conditions.

18. The method according to claim 14, further comprising the step of obtaining second temperature-profile information for a second fluid introduced through the wellbore into the subterranean formation under a second set of introducing conditions, wherein:

(i) at least the second fluid is different from the first fluid; or (ii) at least the second set of introducing conditions is different from the first set of introducing conditions; and wherein the step of analyzing further comprises using the second temperature-profile information to create a model of the thermal conditions to which the first fluid and the second fluid are subjected to when introduced through the wellbore into the formation under the first and second sets of introducing conditions, respectively.

19. The method according to claim 18, wherein the second fluid does not comprise at least one of the reactants of the chemical reaction or does not comprise any catalyst for the chemical reaction such that the chemical reaction does not occur when the second fluid is introduced through the wellbore and into the subterranean formation.

20. A method for designing and performing a treatment operation on a subterranean formation penetrated by a wellbore, wherein the treatment operation includes the use of a treatment fluid comprising reactants for a chemical reaction, the method comprising the steps of:

(a) obtaining wellbore temperature-profile information;

(b) obtaining kinetic information of the extent of the chemical reaction over time under at least one test temperature profile for a test fluid comprising the reactants for the chemical reaction;

(c) analyzing at least the wellbore temperature-profile information and the kinetic information to help design a minimum residence time for the treatment fluid in the subterranean formation at the temperature of the subterranean formation to allow for at least a desired percent completion of the chemical reaction;

(d) introducing the treatment fluid through the wellbore into the subterranean formation under a treatment set of introducing conditions;

(e) measuring the treatment temperature-profile for the treatment fluid when it is introduced through the wellbore into the subterranean formation under the treatment set of introducing conditions;

(f) obtaining heat-of-reaction information for the chemical reaction; and (g) shutting-in the well to provide at least the designed minimum residence time;

wherein the step of analyzing further comprises analyzing with the treatment temperature-profile information and the heat-of-reaction information.

21. A method for designing and performing a treatment operation on a subterranean formation penetrated by a wellbore, wherein the treatment operation includes the use of a treatment fluid comprising reactants for a chemical reaction, the method comprising the steps of:

(a) obtaining wellbore temperature-profile information;

(b) measuring the treatment temperature-profile for the treatment fluid when it is introduced through the wellbore into the subterranean formation under the treatment set of introducing conditions;

(c) obtaining heat-of-reaction information for the chemical reaction;

(d) analyzing at least the wellbore temperature-profile information, the treatment temperature-profile information, and the heat of reaction to help estimate the extent of the chemical reaction as the fluid enters the subterranean formation and to help design a minimum residence time for the treatment fluid in the subterranean formation at the temperature of the subterranean formation to allow for at least a desired percent completion of the chemical reaction;

(e) shutting-in the well to provide at least the designed minimum residence time; and (f) obtaining kinetic information of the extent of the chemical reaction over time under at least one test temperature profile for a test fluid comprising the reactants for the chemical reaction;

wherein the step of analyzing further comprises analyzing with the kinetic information.

* * * * *